US005816576A

United States Patent [19]

Aramapakul et al.

[11] Patent Number: 5,816,576

[45] Date of Patent: Oct. 6, 1998

[54] METHOD OF PLAYING A RUMMY-TYPE CARD GAME

[76] Inventors: Paiboon Aramapakul; Susan Travis, both of 2708 E. 15th St., Long Beach, Calif. 90804

[21] Appl. No.: 934,882

[22] Filed: Sep. 22, 1997

Related U.S. Application Data

[63] Continuation-in-part of Ser. No. 763,253, Dec. 10, 1996, abandoned.

[51] Int. Cl.[6] ..... A63F 1/00

[52] U.S. Cl. ..... 273/292

[58] Field of Search ..... 273/292, 303, 273/305

[56] References Cited

U.S. PATENT DOCUMENTS 5,702,106 12/1997 Alvarez, Jr. ..... 273/292

5,725,215 3/1998 Hesse ..... 273/292

5,735,524 4/1998 Wisted ..... 273/292 X

OTHER PUBLICATIONS

John Scarne, *Scarne's Encyclopedia of Games,* Harper & Row, Chapters 4–6 pp. 54–117, Dec. 1973.

*Primary Examiner*—William E. Stoll

*Attorney, Agent, or Firm*—Ted Masters

[57] ABSTRACT

A card game (20) of the rummy-type has as its object the melding of groups of cards whose summed numerical value equals a preestablished target numerical sum. In a preferred embodiment, groups of two cards which sum to ten can be melded. The player who melds all his/her cards is declared the winner and collects the wagers of all the other players.

20 Claims, 5 Drawing Sheets

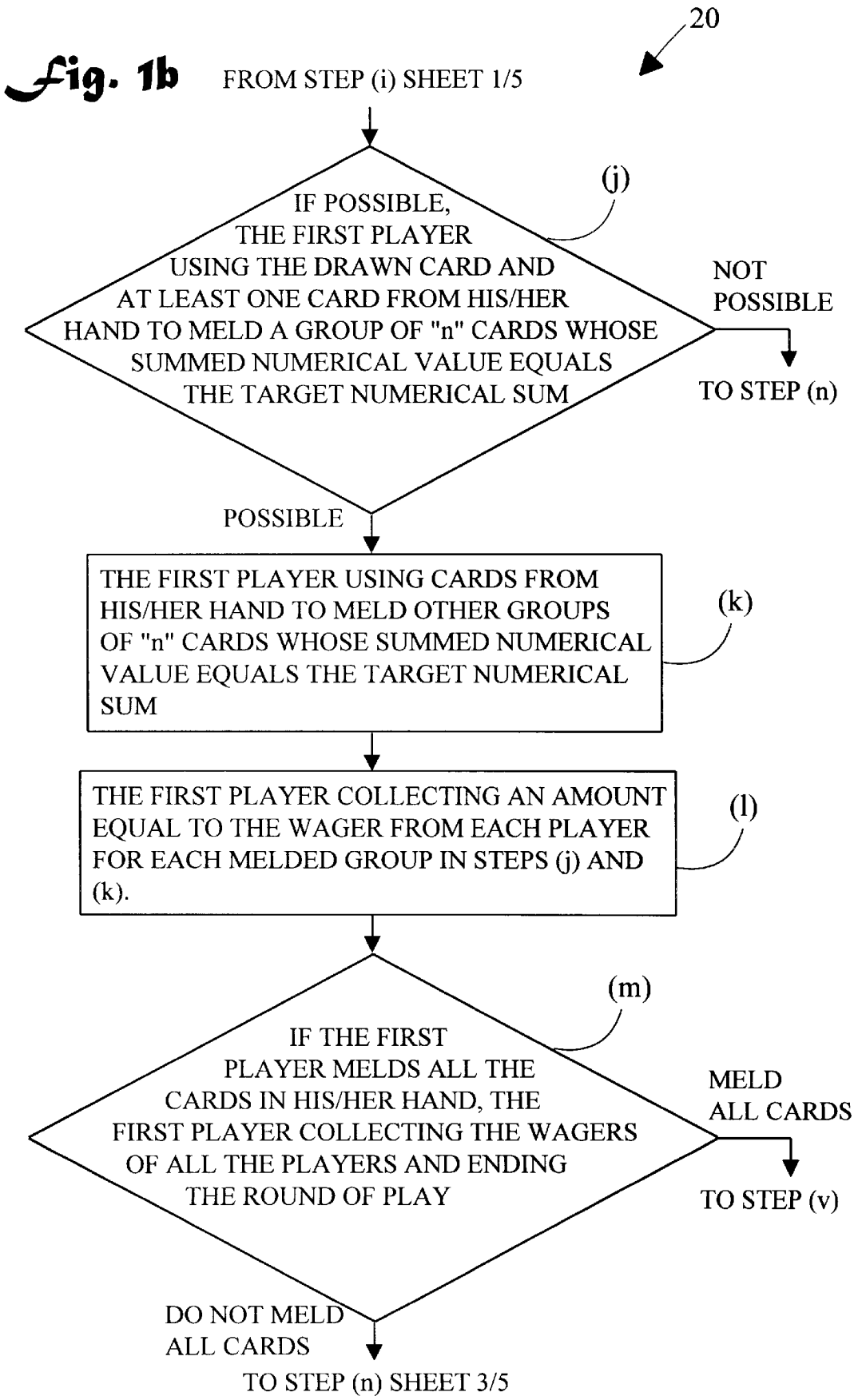
20
Fig. 1b
FROM STEP (i) SHEET 1/5
(j)
IF POSSIBLE, THE FIRST PLAYER USING THE DRAWN CARD AND AT LEAST ONE CARD FROM HIS/HER HAND TO MELD A GROUP OF "n" CARDS WHOSE SUMMED NUMERICAL VALUE EQUALS THE TARGET NUMERICAL SUM
NOT POSSIBLE
TO STEP (n)
POSSIBLE
THE FIRST PLAYER USING CARDS FROM HIS/HER HAND TO MELD OTHER GROUPS OF "n" CARDS WHOSE SUMMED NUMERICAL VALUE EQUALS THE TARGET NUMERICAL SUM
(k)
THE FIRST PLAYER COLLECTING AN AMOUNT EQUAL TO THE WAGER FROM EACH PLAYER FOR EACH MELDED GROUP IN STEPS (j) AND (k).
(l)
(m)
IF THE FIRST PLAYER MELDS ALL THE CARDS IN HIS/HER HAND, THE FIRST PLAYER COLLECTING THE WAGERS OF ALL THE PLAYERS AND ENDING THE ROUND OF PLAY
MELD ALL CARDS
TO STEP (v)
DO NOT MELD ALL CARDS
TO STEP (n) SHEET 3/5

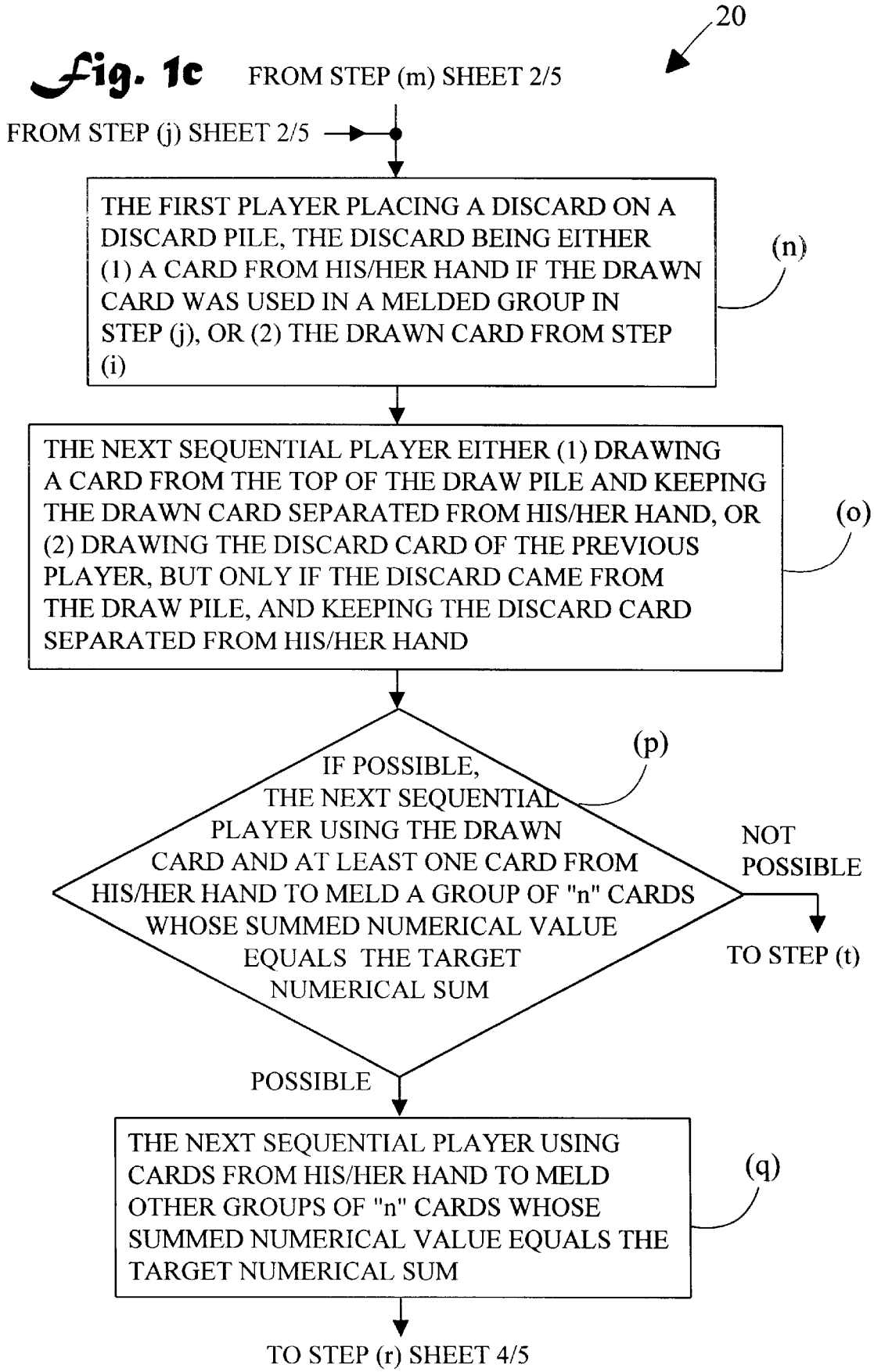
20
Fig. 1c
FROM STEP (m) SHEET 2/5
FROM STEP (j) SHEET 2/5
THE FIRST PLAYER PLACING A DISCARD ON A DISCARD PILE, THE DISCARD BEING EITHER (1) A CARD FROM HIS/HER HAND IF THE DRAWN CARD WAS USED IN A MELDED GROUP IN STEP (j), OR (2) THE DRAWN CARD FROM STEP (i)
(n)
THE NEXT SEQUENTIAL PLAYER EITHER (1) DRAWING A CARD FROM THE TOP OF THE DRAW PILE AND KEEPING THE DRAWN CARD SEPARATED FROM HIS/HER HAND, OR (2) DRAWING THE DISCARD CARD OF THE PREVIOUS PLAYER, BUT ONLY IF THE DISCARD CAME FROM THE DRAW PILE, AND KEEPING THE DISCARD CARD SEPARATED FROM HIS/HER HAND
(o)
(p)
IF POSSIBLE, THE NEXT SEQUENTIAL PLAYER USING THE DRAWN CARD AND AT LEAST ONE CARD FROM HIS/HER HAND TO MELD A GROUP OF "n" CARDS WHOSE SUMMED NUMERICAL VALUE EQUALS THE TARGET NUMERICAL SUM
NOT POSSIBLE
TO STEP (t)
POSSIBLE
THE NEXT SEQUENTIAL PLAYER USING CARDS FROM HIS/HER HAND TO MELD OTHER GROUPS OF "n" CARDS WHOSE SUMMED NUMERICAL VALUE EQUALS THE TARGET NUMERICAL SUM
(q)
TO STEP (r) SHEET 4/5

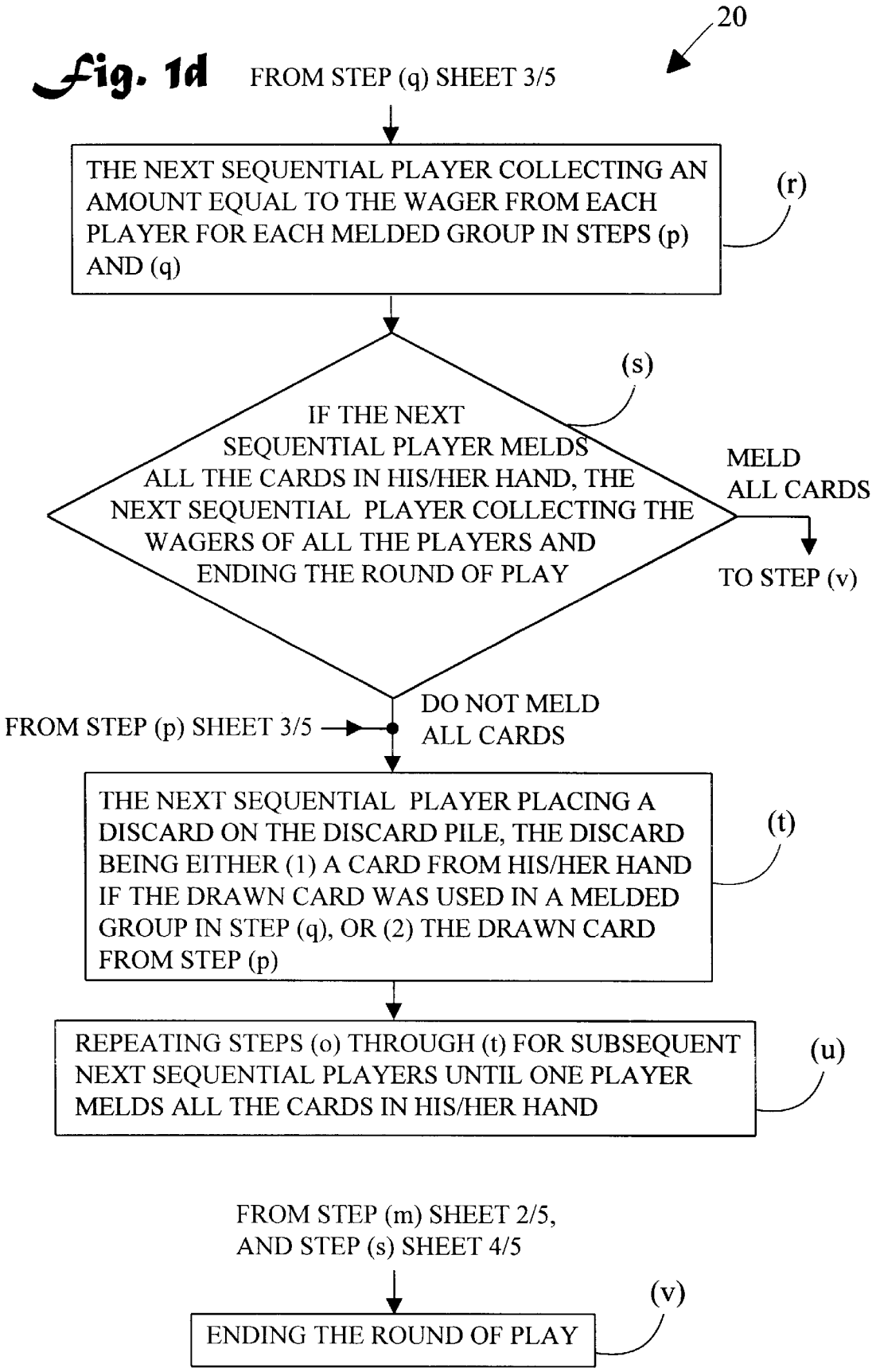
20
Fig. 1d
FROM STEP (q) SHEET 3/5
THE NEXT SEQUENTIAL PLAYER COLLECTING AN AMOUNT EQUAL TO THE WAGER FROM EACH PLAYER FOR EACH MELDED GROUP IN STEPS (p) AND (q)
(r)
(s)
IF THE NEXT SEQUENTIAL PLAYER MELDS ALL THE CARDS IN HIS/HER HAND, THE NEXT SEQUENTIAL PLAYER COLLECTING THE WAGERS OF ALL THE PLAYERS AND ENDING THE ROUND OF PLAY
MELD ALL CARDS
TO STEP (v)
DO NOT MELD ALL CARDS
FROM STEP (p) SHEET 3/5
THE NEXT SEQUENTIAL PLAYER PLACING A DISCARD ON THE DISCARD PILE, THE DISCARD BEING EITHER (1) A CARD FROM HIS/HER HAND IF THE DRAWN CARD WAS USED IN A MELDED GROUP IN STEP (q), OR (2) THE DRAWN CARD FROM STEP (p)
(t)
REPEATING STEPS (o) THROUGH (t) FOR SUBSEQUENT NEXT SEQUENTIAL PLAYERS UNTIL ONE PLAYER MELDS ALL THE CARDS IN HIS/HER HAND
(u)
FROM STEP (m) SHEET 2/5, AND STEP (s) SHEET 4/5
ENDING THE ROUND OF PLAY
(v)

METHOD OF PLAYING A RUMMY-TYPE CARD GAME

CROSS REFERENCE TO RELATED APPLICATION

This application is a continuation-in-part of application No. 08/763,253 entitled WAGERING NONWAGERING CARD GAME, filed on Dec. 10, 1996, now abandoned, the disclosure of which is incorporated herein by reference.

TECHNICAL FIELD

The present invention pertains to card games, and particularly to card games of the rummy-type.

BACKGROUND ART

Card games of the rummy-type, such as Gin Rummy, are well known in the art. The object of these games is to form matched sets, groups, and sequences of cards called melds or lays. Chapters 4–6 of SCARNE'S ENCYCLOPEDIA OF CARD GAMES, by John Scarne, Harper and Row Publishers, 10 East 53rd Street, New York, N.Y. 10022, describe several of these games.

DISCLOSURE OF INVENTION

The present invention is directed to a card game of the rummy-type which is easily understood and quickly played. The game is adapted for play in casinos, but can also be played at home for entertainment with friends and family. A suggested name for the present invention is Asian Gin Rummy.

The present invention has many possible embodiments wherein the following parameters may be varied, yet the principles, steps, and method of play of the invention remaining constant:

(1) the number of cards dealt to each player;
(2) the numerical value of each card;
(3) the target numerical melding sum; and,
(4) the number of cards in a meld (2, 3, 4, 5, etc).

In accordance with a preferred embodiment of the invention nine cards are dealt to each player. Cards ace through nine have values of one through nine respectively, with tens, jacks, queens, and kings having a value of five. The target numerical melding sum is ten, and the number of cards "n" in a meld is two (n=2). That is, the object of the game is to form two card melded pairs whose summed numerical value equals ten (e.g. a two and an eight).

To start the game, the first player draws a tenth card from a draw pile. If he/she can use the drawn card combined with a card from his/her hand to form a summed numerical value of ten, then the drawn card and the card from the hand are melded face up on the playing table. If the first player cannot use the drawn card to meld, then the drawn card must be discarded on a discard pile for the next sequential player. After melding the drawn card, the first player can meld any other pairs of cards in his/her hand which add up to ten. An amount equal to an initial wager is then collected from all players for each melded pair. If the first player can meld all his/her cards, then he/she also wins the wagers of all the players and the round of play is ended. If the first player cannot meld all the cards in his/her hand, then he/she discards a card on the discard pile and the next sequential player plays. This process continues until one of the players is able to meld all the cards in his/her hand.

In accordance with an important aspect of the invention, the game is played with one or more conventional decks of 52 cards.

In accordance with another aspect of the invention, one or more supplemental cards may be added to each deck (e.g. a joker).

In accordance with an important feature of the invention, after inspecting his/her hand, each player is afforded the option of folding and losing his/her wager.

In accordance with an aspect of the invention, the game may or may not permit a final discard when melding all the cards.

The skill of the present invention is found in the player's ability to view the opponents melds and discards placed upon the playing table, and thereby direct the strategy of play. For example, if a player observes that all Kings have been melded, then he/she knows that it is safe to discard a King.

Unlike other forms of rummy, in the present invention the players do not subtract points from their melds for the cards remaining in their hands when another player is declared the winner.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1A:
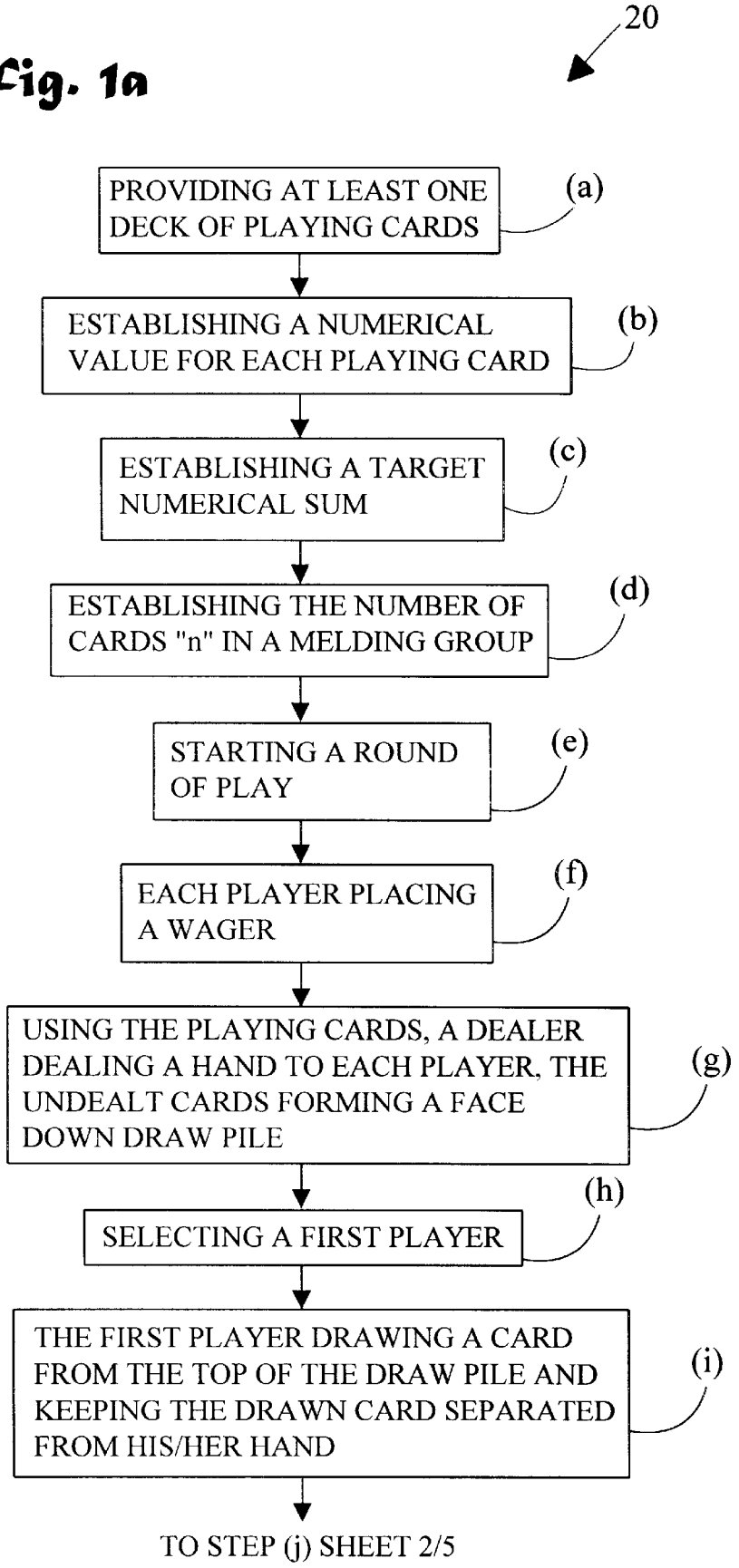
FIG. 1(*a*)–1(*d*) is a flow diagram illustrating the steps and method of play of a card game in accordance with the present invention; and, FIG. 2 is a plan view of a playing table layout.

Referring initially to FIG. 1, there is illustrated a flow diagram illustrating the steps and method of play of a card game in accordance with the present invention, generally designated as 20. Card game 20 may include a plurality of card receiving players, with between two and eight being preferred. The players include a dealer, who may either be participating or non-participating depending upon state and local laws. The present invention is particularly suited for play at a casino or other gaming establishment.

Card game 20 begins with step (a) wherein at least one deck of playing cards is provided. In a preferred embodiment, multiple decks are utilized, with the cards being dealt from a shoe. Also in a preferred embodiment, a conventional 52 card deck is used, however it would also be possible to add one or more supplemental cards such as jokers to the conventional deck, or alternatively remove one or more selected cards. Further, while in a preferred embodiment of the card game playing cards are utilized, it may be readily appreciated that other playing media such as tiles could also be employed.

In step (b) numerical values are established or assigned to each playing card in the deck. In a preferred embodiment the established values are:

an ace is one;
a two is two;
a three is three;
a four is four;
a five is five;
a six is six;
a seven is seven;
an eight is eight;
a nine is nine;
a ten is five;

a jack is five;
a queen is five; and,
a king is five.

If a joker is used, it may assigned any value between one and nine by the player holding the joker.

In step (c) a target numerical sum is established, and in step (d) the number of cards n in a melding group is established. The target numerical sum is the sum to which a group of n playing cards must sum in order to produce a meld. For example, using the numerical values of step (b), a target numerical sum of ten, and two cards (n=2) in a melding group, the object of the game would be to meld two card groups which sum to ten. That is:
ace+nine;
two+eight;
three+seven;
four+six;
five+five;
ten+ten, or jack, or queen, or king;
jack+ten, or jack, or queen, or king;
queen+ten, or jack, or queen, or king; and,
king+ten, or jack, or queen, or king.

If a joker is used, it can be summed with any other card to form the target numerical sum of ten.

In accordance with a preferred embodiment, the melding of tens and face cards is limited. To wit, a ten can only be summed with another ten, a jack can only be summed with another jack, a queen can only be summed with another queen, and a king can only be summed with another king. In this embodiment, there are only nine possible melding combinations.

In another possible embodiment, the target numerical sum could be 15 using three card meld groups (n=3), so that a meld would be possible with an ace+six+eight, or four+seven+four, or king+five+queen, etc. The possible combinations of card numerical values, target numerical sums, and number of cards n in a melding group are almost unlimited.

After the basic parameters of game 20 are established in steps (a) through (d), in step (e) a round of play is started. It may be appreciated that while it is preferable to retain the basic parameters of steps (a) through (d) throughout all rounds of play, it would also be possible to change one or more of these parameters between rounds of play.

In step (f) each player places a wager sometimes called an ante. In a preferred embodiment the wagers of all the players are of the same amount, which is the table limit. If the present invention is practiced in a gaming establishment having a non-participating house dealer, the players will also contribute a predetermined collection amount to the dealer for each hand. This collection constitutes payment to the gaming establishment for the cost and profit of conducting the game.

In step (g), using the deck or decks of playing cards, the dealer deals a plurality of playing cards or hand to each player, and a face down draw pile is formed from all undealt cards. In a preferred embodiment the number of playing cards dealt to each player is nine, however other numbers of cards could also be dealt (eight, ten, eleven, etc.). The number of playing cards dealt to each player, and the number of cards n in a melding group should be compatible. For example, if a player is dealt nine cards and draws a tenth card to start play, a melding group of two (n=2) would result in five possible melds with no final discard. Similarly, if a player is dealt nine cards and draws a tenth card, a melding group of three (n=3) would result in three possible melds with a final discard. Similarly, if a player is dealt eleven cards and draws a twelfth, a melding group of four (n=4) would result in three possible melds with no final discard. However, if a player is dealt ten cards and draws an eleventh, a melding group of three (n=3) would result in three melding groups with two cards left over, and therefore be undesirable. If the plurality of playing cards dealt to each player plus one is divisible by n with no remainder, then there will be no final discard when all the playing cards are melded. On the other hand, if the plurality of playing cards dealt to each player is divisible by n with no remainder, then there will be a final discard when all the playing cards are melded. In a preferred embodiment, after the playing cards have been dealt in step (g), and have been evaluated, each player is afforded the option of folding (surrendering or quitting) his/her hand and not playing during that round of play. However, the wager of a folding player remains on the table, and will ultimately be collected by the winner.

In step (h) a first player for the round of play is selected. The selection may be made by any of numerous methods such as by turning over one card in each player's hand and having the player with either the high or low card play first, rolling dice, using coins, or simply having the player immediately adjacent to the dealer play first, etc. In a preferred embodiment, after the first round of play is completed, the winning player is the first to play in the next round.

In step (i) the first player draws a card from the top of the draw pile, but keeps the drawn card separated from his/her hand.

In step (j), if it is possible, the first player uses the drawn card and at least one card from his/her hand to meld a group of n cards whose summed numerical value equals the target numerical sum. For example, with nine cards dealt to each player and two cards in a melding group (n=2), let us suppose that the drawn card is a six. If the first player has a four in his/her hand, he/she can put down on the table or meld the target numerical sum of ten. Similarly, if the drawn card was a three and the first player has a seven in his/her hand, he/she could also meld ten. If the number of cards n in a melding group were three (n=3), then two cards from the players hand could be combined with the drawn card to form the meld. If the first player cannot use the drawn card in combination with one or more cards from his/her hand to meld the target numerical sum, then he/she must discard the drawn card (refer to step (n) below).

If the first player was able to use the drawn card to meld the target numerical sum, then in step (k) the first player can use the cards in his/her hand to meld other groups of n cards whose summed numerical value equals the target numerical sum. For example as before, with nine cards dealt to each player and two cards in a melding group (n=2), let us suppose that the drawn card is a six. If the first player has a four in his/her hand, he/she can put down on the table or meld the target numerical sum of ten. Let us also suppose that the first player now has the following cards remaining in his/her hand:
ace of hearts
seven of clubs
four of diamonds
nine of spades
three of diamonds
jack of hearts
jack of clubs, and
two of spades.

The first player can now also meld the (1) the ace of hearts and the nine of spades, (2) the seven of clubs and the three of diamonds, and (3) the jack of hearts and the jack of clubs, leaving only the four of diamonds and two of spades in his/her hand.

In step (1) the first player collects an amount equal to the wager for each melded group in steps (j) and (k) above from all other players. In the previous example, the first player melded one group in step (j) and three additional groups in step (k), and would therefore collect an amount equal to four wagers from all other players (except those that may have folded). In an alternative embodiment, step (l) is performed immediately prior to step (v). That is, the collection for each melded group is not made until the end of the round of play. Also, in the alternative embodiment, step (r) is performed immediately prior to step (v).

In step (m), if the first player can meld all cards in his/her hand, the first player then also collects all the wagers and the round of play is ended in step (v). For example, after putting down the first meld using the drawn card, let us also suppose that the first player now has the following cards remaining in his/her hand:

ace of hearts
seven of clubs
four of diamonds
nine of spades
three of diamonds
jack of hearts
jack of clubs, and
six of spades.

The first player can now also meld the (1) the ace of hearts and the nine of spades, (2) the seven of clubs and the three of diamonds, (3) the jack of hearts and the jack of clubs, and (4) the four of diamonds and the six of spades, leaving no cards remaining in his/her hand.

It is noted that if a tenth card were originally dealt to each player, say the queen of spades in the above example, then in steps (m), (s), and (u), the act of "melding all the cards in his/her hand" would include a final discard on the discard pile of the unused card (i.e. the queen of spades). That is, all the cards in his/her hand are melded except one, which is placed upon the discard pile to go out.

Finally, if the first player cannot meld all the cards in his/her hand, then the first player must discard a card from his/her hand and play proceeds to step (n) below.

In step (n) the first player places a discard on a discard pile. If the first player was able to use the drawn card from step (i) as part of a meld group in step (j), the discard will be a card from his/her hand. If the first player was unable to use the drawn card from step (i) as part of a meld group in step (j), the discard must be the drawn card from step (i).

It is now the turn of the next sequential player. The direction of sequential play may be either clockwise or counterclockwise, wherein each player in turn plays after the previous player.

In step (o), the next sequential player either (1) draws a card from the top of the draw pile and keeps the drawn card separated from his/her hand, or (2) draws the discard of the previous player, but only if the discard came from the draw pile, and keeps the discard separated from his/her hand. That is, the next sequential player can pick up the discard of the previous player only if the discard was the card drawn by the previous player from the draw pile, and the discard must be immediately used in a meld. The next sequential player cannot draw a discard if it came from the hand of the previous player, or if the drawn card is not immediately used in a meld. By not allowing a player to draw a discard from the hand of the previous player, the possibility of two players collaborating (cheating) is eliminated. If the next sequential player cannot use the discard of the previous player, then he/she draws a card from the draw pile.

The next sequential player then continues play in accordance with steps (p) through (t), which are the same as steps (j) through (n) of the first player.

In step (u), after the next sequential player has discarded, a subsequent next sequential player repeats steps (o) through (t). The game continues around the table in this fashion until one player melds all the cards in his/her hand and the round of play is ended in step (v).

Figure 2:
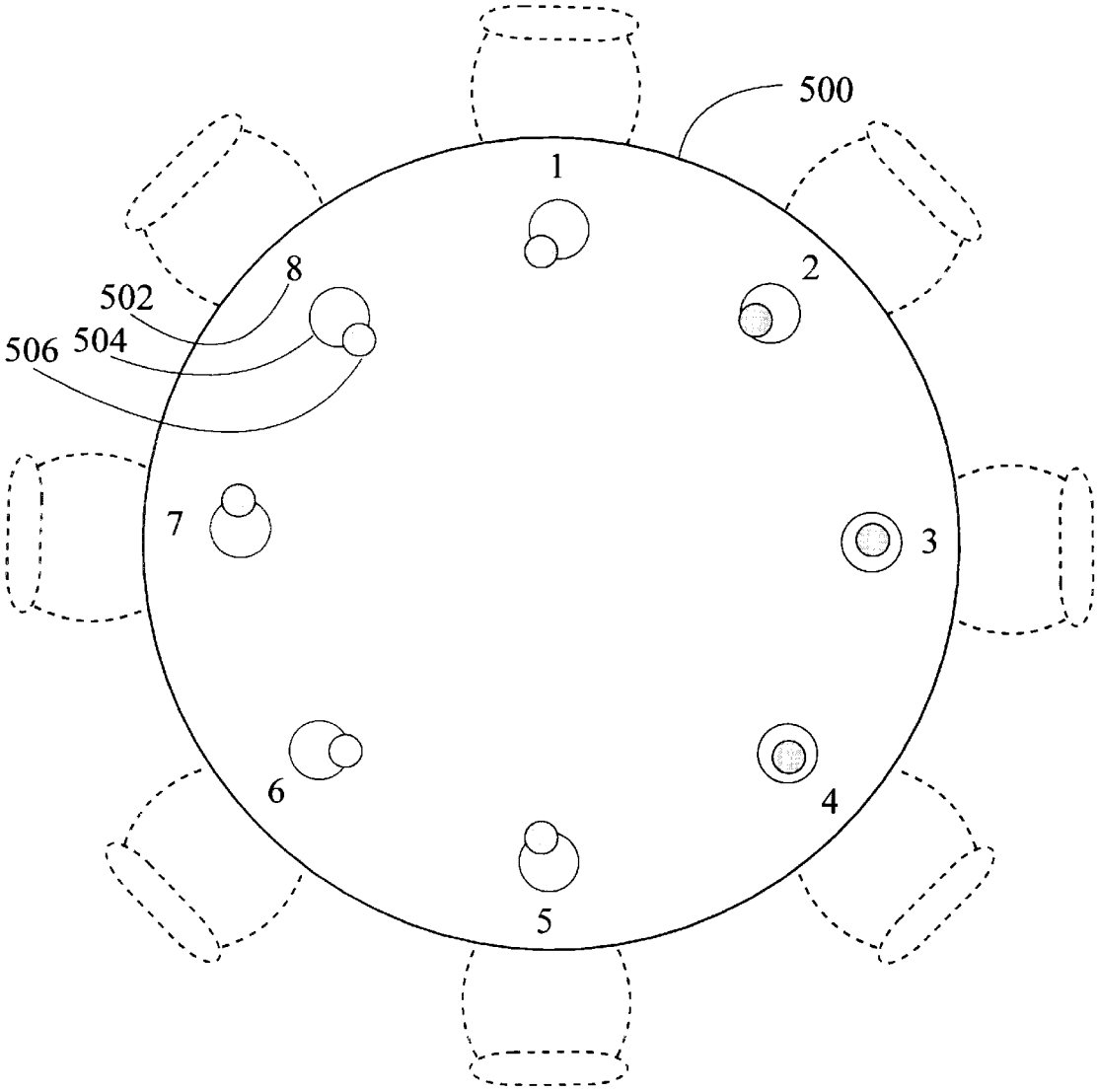

FIG. 2 is a plan view of a playing table layout. Playing table 500 includes a plurality of playing positions 502, eight in the shown embodiment. Indicia depicting the wagering areas 504, playing positions 502, or other pertinent information can be disposed upon the surface of the playing table 500 or a covering thereof. The wagers 506 of each player are placed on the wagering areas 504.

The preferred embodiments of the invention described herein are exemplary and numerous modifications, dimensional variations, and rearrangements can be readily envisioned to achieve an equivalent result, all of which are intended to be embraced within the scope of the appended claims.

We claim:

1. A method of playing a card game played by a plurality of players, comprising the steps of:

(a) providing at least one deck of playing cards;

(b) establishing a numerical value for each said playing card;

(c) establishing a target numerical sum;

(d) establishing the number of cards n in a melding group;

(e) starting a round of play;

(f) each player placing a wager;

(g) using said at least one deck of said playing cards, a dealer dealing a plurality of said playing cards to each player said plurality comprising a hand, a face down draw pile being formed from all undealt said playing cards;

(h) selecting a first player;

(i) the first player drawing a card from the top of said draw pile and keeping said drawn card separated from his/her said hand;

(j) if possible, the first player using said drawn card and at least one card from his/her said hand to meld a group of n cards whose summed numerical value equals said target numerical sum; else proceeding to step (n) below;

(k) the first player using cards from his/her said hand to meld other groups of n cards whose summed numerical value equals said target numerical sum;

(l) the first player collecting an amount equal to said wager for each said melded group, said amount being collected from all other players;

(m) if the first player melds all cards in his/her hand, the first player collecting all said wagers, and proceeding to step (v), else proceeding to step (n);

(n) the first player placing a discard card on a discard pile, said discard being either (1) a card from his/her said hand if said drawn card was used in one said melded group, or (2) said drawn card;

(o) a next sequential player either (1) drawing a card from the top of said draw pile and keeping said drawn card separated from his/her said hand, or (2) drawing said discard card of the previous player but only if said discard came from said draw pile, and keeping said discard card separated from his/her said hand;

(p) if possible, the next sequential player using said drawn card and at least one card from his/her said hand to meld a group of n cards whose summed numerical value equals said target numerical sum; else proceeding to step (t) below;

(q) the next sequential player using cards from his/her said hand to meld other groups of n cards whose summed numerical value equals said target numerical sum;

(r) the next sequential player collecting an amount equal to said wager for each said melded group, said amount being collected from each other player;

(s) if the next sequential player melds all cards in his/her hand, the next sequential player collecting all said wagers, and proceeding to step (v), else proceeding to step (t);

(t) the next sequential player placing a discard card on said discard pile, said discard being either (1) a card from said hand if said drawn card was used in one said melded group, or (2) said drawn card;

(u) repeating steps (o) through (t) for subsequent next sequential players until one player melds all said cards in his/her said hand; and, (v) ending the round of play.

2. The method according to claim 1, wherein said deck of playing cards is a conventional deck which includes 52 cards.

3. The method according to claim 2, further including at least one supplemental card added to said conventional deck of playing cards.

4. The method according to claim 3, wherein said supplemental card is a joker.

5. The method according to claim 1, wherein said numerical value for each said playing card is:

an ace is one;

a two is two;

a three is three;

a four is four;

a five is five;

a six is six;

a seven is seven;

an eight is eight;

a nine is nine;

a ten is five;

a jack is five;

a queen is five; and, a king is five.

6. The method according to claim 5, further including a joker having any numerical value between one and nine.

7. The method according to claim 5, wherein in said steps (j), (k), (p), and (q), a ten can only be summed with another ten, a jack can only be summed with another jack, a queen can only be summed with another queen, and a king can only be summed with another king.

8. The method according to claim 1, wherein said target numerical sum is ten.

9. The method according to claim 1, wherein said wager of each player is the same amount.

10. The method according to claim 1, wherein said plurality of said playing cards is nine.

11. The method according to claim 1, wherein n=two.

12. The method according to claim 1, wherein a direction of sequential play is either clockwise or counterclockwise.

13. The method according to claim 1, further including the step of:

after said step (g), each player being afforded the option of folding his/her hand.

14. The method according to claim 1, wherein said plurality of players is between two and eight.

15. The method according to claim 1, wherein said plurality of said playing cards dealt to each player plus one is divisible by n with no remainder.

16. The method according to claim 1, wherein said plurality of said playing cards dealt to each player is divisible by n with no remainder.

17. The method according to claim 1, wherein in steps (m), (s), and (u) the phrase "melding all cards in his/her hand" includes placing a final discard card on said discard pile.

18. The method according to claim 1, wherein steps (1) and (r) are performed immediately prior to step (v).

19. A method of playing a card game played by a plurality of players, comprising the steps of:

(a) providing at least one deck of playing cards;

(b) establishing a numerical value for each said playing card;

(c) establishing a target numerical sum;

(d) establishing the number of cards n in a melding group;

(e) starting a round of play;

(f) each player placing a wager;

(g) using said at least one deck of said playing cards, a dealer dealing a plurality of said playing cards to each player said plurality comprising a hand, a face down draw pile being formed from all undealt said playing cards;

(h) selecting a first player;

(i) the first player drawing a card from the top of said draw pile and keeping said drawn card separated from his/her said hand;

(j) if possible, the first player using said drawn card and at least one card from his/her said hand to meld a group of n cards whose summed numerical value equals said target numerical sum; else proceeding to step (n) below;

(k) the first player using cards from his/her said hand to meld other groups of n cards whose summed numerical value equals said target numerical sum;

(l) the first player collecting an amount equal to said wager for each said melded group, said amount being collected from all other players;

(m) if the first player melds all cards in his/her hand except one, the first player collecting all said wagers, and proceeding to step (v), else proceeding to step (n);

(n) the first player placing a discard card on a discard pile, said discard being either (1) a card from his/her said hand if said drawn card was used in one said melded group, or (2) said drawn card;

(o) a next sequential player either (1) drawing a card from the top of said draw pile and keeping said drawn card separated from his/her said hand, or (2) drawing said discard card of the previous player but only if said discard came from said draw pile, and keeping said discard card separated from his/her said hand;

(p) if possible, the next sequential player using said drawn card and at least one card from his/her said hand to meld a group of n cards whose summed numerical value equals said target numerical sum; else proceeding to step (t) below;

(q) the next sequential player using cards from his/her said hand to meld other groups of n cards whose summed numerical value equals said target numerical sum;

(r) the next sequential player collecting an amount equal to said wager for each said melded group, said amount being collected from all other players;

(s) if the next sequential player melds all cards in his/her hand except one, the next sequential player collecting all said wagers, and proceeding to step (v), else proceeding to step (t);

(t) the next sequential player placing a discard card on said discard pile, said discard being either (1) a card from his/her said hand if said drawn card was used in one said melded group, or (2) said drawn card;

(u) repeating steps (o) through (t) for subsequent next sequential players until one player melds all said cards in his/her said hand except one; and, (v) ending the round of play.

20. A method of playing a card game played by a plurality of players, comprising the steps of:

(a) providing at least one deck of playing cards;

(b) establishing a numerical value for each said playing card as follows:
an ace is one;
a two is two;
a three is three;
a four is four;
a five is five;
a six is six;
a seven is seven;
an eight is eight;
a nine is nine;
a ten is five;
a jack is five;
a queen is five; and,
a king is five;

(c) establishing a target numerical sum of ten;

(d) establishing the number of cards in a meld as two;

(e) starting a round of play;

(f) each player placing a wager;

(g) using said at least one deck of said playing cards, a dealer dealing nine playing cards to each player said nine playing cards comprising a hand, a face down draw pile being formed from all undealt said playing cards;

(h) selecting a first player;

(i) the first player drawing a card from the top of said draw pile and keeping said drawn card separated from his/her said hand;

(j) if possible, the first player using said drawn card and one card from his/her said hand to meld a group of two cards whose summed numerical value equals ten; else proceeding to step (n) below;

(k) if possible, the first player using cards from his/her said hand to meld other groups of two cards whose summed numerical value equals ten;

(l) the first player collecting an amount equal to said wager for each said melded group, said amount being collected from all other players;

(m) if the first player melds all cards in his/her hand, the first player collecting all said wagers, and proceeding to step (v), else proceeding to step (n);

(n) the first player placing a discard card on a discard pile, said discard being either (1) a card from his/her said hand if said drawn card was used in one said melded group, or (2) said drawn card;

(o) a next sequential player either (1) drawing a card from the top of said draw pile and keeping said drawn card separated from his/her said hand, or (2) drawing said discard card of the previous player but only if said discard came from said draw pile, and keeping said discard card separated from his/her said hand;

(p) if possible, the next sequential player using said drawn card and one card from his/her said hand to meld a group of two cards whose summed numerical value equals ten; else proceeding to step (t) below;

(q) the next sequential player using cards from his/her said hand to meld other groups of two cards whose summed numerical value equals ten;

(r) the next sequential player collecting an amount equal to said wager for each said melded group, said amount being collected from all other players;

(s) if the next sequential player melds all cards in his/her hand, the next sequential player collecting all said wagers, and proceeding to step (v), else proceeding to step (t);

(t) the next sequential player placing a discard card on said discard pile, said discard being either (1) a card from his/her said hand if said drawn card was used in one said melded group, or (2) said drawn card;

(u) repeating steps (o) through (t) for subsequent next sequential players until one player melds all cards in his/her said hand; and, (v) ending the round of play.

* * * * *